US009574713B2

(12) United States Patent
Turner et al.

(10) Patent No.: US 9,574,713 B2
(45) Date of Patent: Feb. 21, 2017

(54) VAPORIZATION CHAMBERS AND ASSOCIATED METHODS

(75) Inventors: Terry D. Turner, Idaho Falls, ID (US); Bruce M. Wilding, Idaho Falls, ID (US); Michael G. McKellar, Idaho Falls, ID (US); Lee P. Shunn, Idaho Falls, ID (US)

(73) Assignee: BATTELLE ENERGY ALLIANCE, LLC, Idaho Falls, ID (US)

( * ) Notice: Subject to any disclaimer, the term of this patent is extended or adjusted under 35 U.S.C. 154(b) by 1176 days.

(21) Appl. No.: 12/938,761

(22) Filed: Nov. 3, 2010

(65) Prior Publication Data

US 2012/0103428 A1 May 3, 2012

(51) Int. Cl.
*F28D 15/00* (2006.01)
*F17D 1/18* (2006.01)

(52) U.S. Cl.
CPC ..... *F17D 1/18* (2013.01); *F28D 15/00* (2013.01); *Y10T 137/0391* (2015.04)

(58) Field of Classification Search
CPC ..... F17D 1/18; F17D 1/16; F17D 1/17; F28D 15/00; F28D 15/02
USPC ..... 62/601, 602, 603, 618, 637, 928, 929
See application file for complete search history.

(56) References Cited

U.S. PATENT DOCUMENTS

| | | | |
|---|---|---|---|
| 1,222,801 | A | 4/1917 | Rosenbaum |
| 2,037,679 | A | 4/1936 | Dana |
| 2,037,714 | A | 4/1936 | Gaines, Jr. |
| 2,040,059 | A | 5/1936 | Mesinger |
| 2,093,805 | A | 9/1937 | de Baufre |
| 2,157,103 | A | 5/1939 | Zenner |
| 2,209,534 | A | 7/1940 | Moore |
| 2,494,120 | A | 10/1950 | Ferro, Jr. |
| 2,669,941 | A | 2/1954 | Stafford |
| 2,701,641 | A | 2/1955 | Krijgsman |

(Continued)

FOREIGN PATENT DOCUMENTS

| | | | |
|---|---|---|---|
| CN | 101539362 | A | 9/2009 |
| EP | 0 676 599 | A | 10/1995 |

(Continued)

OTHER PUBLICATIONS

Search Report for PCT/US2006/041039 dated Aug. 8, 2007.

(Continued)

*Primary Examiner* — Frantz Jules
*Assistant Examiner* — Brian King
(74) *Attorney, Agent, or Firm* — TraskBritt

(57) ABSTRACT

A vaporization chamber may include at least one conduit and a shell. The at least one conduit may have an inlet at a first end, an outlet at a second end and a flow path therebetween. The shell may surround a portion of each conduit and define a chamber surrounding the portion of each conduit. Additionally, a plurality of discrete apertures may be positioned at longitudinal intervals in a wall of each conduit, each discrete aperture of the plurality of discrete apertures sized and configured to direct a jet of fluid into each conduit from the chamber. A liquid may be vaporized by directing a first fluid comprising a liquid into the inlet at the first end of each conduit, directing jets of a second fluid into each conduit from the chamber through discrete apertures in a wall of each conduit and transferring heat from the second fluid to the first fluid.

27 Claims, 4 Drawing Sheets

(56) References Cited

U.S. PATENT DOCUMENTS 2,858,020 A 10/1958 Bek
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,218,816 A 11/1965 Grenier
3,236,057 A 2/1966 Hadi Hashemi-Tafreshi
3,254,496 A 6/1966 Roche et al.
3,289,756 A 12/1966 Jaeger
3,292,380 A 12/1966 Bucklin
3,312,073 A 4/1967 Jackson et al.
3,315,475 A 4/1967 Harmens
3,323,315 A 6/1967 Carr
3,326,453 A 6/1967 Kun
3,349,020 A 10/1967 Crownover et al.
3,362,173 A 1/1968 Kneil
3,376,709 A 4/1968 Dickey et al.
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,516,262 A 6/1970 Bernstein
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,667,234 A * 6/1972 De Lizasoain ..... 405/80
3,677,019 A 7/1972 Olszewski
3,690,114 A 9/1972 Swearingen et al.
3,724,225 A 4/1973 Mancini et al.
3,724,226 A 4/1973 Pachaly
3,735,600 A 5/1973 Dowdell et al.
3,846,993 A 11/1974 Bates
3,886,885 A 6/1975 Becker et al.
3,897,226 A 7/1975 Doherty
4,001,116 A 1/1977 Selcukoglu
4,004,430 A 1/1977 Solomon et al.
4,007,601 A 2/1977 Webbon
4,022,597 A 5/1977 Bacon
4,025,315 A 5/1977 Mazelli
4,032,337 A 6/1977 Boyer
4,120,911 A 10/1978 Davidson
4,128,410 A 12/1978 Bacon
4,148,723 A 4/1979 Mozley
4,161,107 A 7/1979 Chernyshev et al.
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradowski
4,359,871 A 11/1982 Strass
4,370,150 A 1/1983 Fenstermaker
4,453,956 A 6/1984 Fabbri et al.
4,456,459 A 6/1984 Brundige
4,479,533 A 10/1984 Persson et al.
4,479,536 A 10/1984 Lameris
4,522,636 A 6/1985 Markbreiter et al.
4,528,006 A * 7/1985 Vitovec et al. ..... 55/360
4,561,496 A 12/1985 Kehrer
4,609,390 A 9/1986 Wilson
4,611,655 A 9/1986 Molignoni
4,645,522 A 2/1987 Dobrotwir
4,654,522 A 3/1987 Gornick et al.
4,783,272 A 11/1988 Patterson
4,798,242 A 1/1989 Kito et al.
4,822,393 A 4/1989 Markbreiter et al.
4,846,862 A 7/1989 Cook
4,869,313 A 9/1989 Fredley
4,970,867 A 11/1990 Harron et al.
4,993,485 A 2/1991 Gorman
4,994,097 A 2/1991 Brouwers
5,003,782 A 4/1991 Kucerija
5,032,143 A 7/1991 Ritakallio
5,036,671 A 8/1991 Nelson et al.
5,062,270 A 11/1991 Haut et al.
5,074,758 A 12/1991 McIntyre
5,174,796 A 12/1992 Davis et al.
5,218,832 A 6/1993 Woolley
5,252,613 A 10/1993 Chang et al.
5,291,736 A 3/1994 Paradowski
5,325,673 A 7/1994 Durr et al.
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,473,900 A 12/1995 Low
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,701,761 A 12/1997 Prevost et al.
5,704,227 A 1/1998 Krabbendam
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,950,453 A 9/1999 Bowen et al.
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 4/2001 Hass et al.
6,250,244 B1 6/2001 Dubar et al.
6,295,833 B1 10/2001 Hoffart et al.
6,301,927 B1 10/2001 Reddy
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,397,936 B1 * 6/2002 Crowley et al. ..... 165/104.26
6,400,896 B1 6/2002 Longardner
6,410,087 B1 6/2002 Wilde et al.
6,412,302 B1 7/2002 Foglietta
6,425,263 B1 7/2002 Bingham et al.
6,427,464 B1 8/2002 Beaverson et al.
6,441,263 B1 8/2002 O'Rear et al.
6,442,969 B1 9/2002 Rojey et al.
6,446,465 B1 9/2002 Dubar

(56) References Cited

U.S. PATENT DOCUMENTS

| | | | | |
|---|---|---|---|---|
| 6,484,533 | B1 | 11/2002 | Allam et al. | |
| 6,581,409 | B2 | 6/2003 | Wilding et al. | |
| 6,581,510 | B2 | 6/2003 | Koch et al. | |
| 6,694,774 | B1 | 2/2004 | Rashad et al. | |
| 6,742,358 | B2 | 6/2004 | Wilkinson et al. | |
| 6,767,388 | B2 | 7/2004 | Lecomte et al. | |
| 6,793,712 | B2 | 9/2004 | Qualls | |
| 6,962,061 | B2 | 11/2005 | Wilding et al. | |
| 7,078,011 | B2 | 7/2006 | Morrow | |
| 7,219,512 | B1 | 5/2007 | Wilding et al. | |
| 7,228,714 | B2 | 6/2007 | Howard | |
| 7,288,231 | B2 | 10/2007 | Tonkovich et al. | |
| 7,325,415 | B2 | 2/2008 | Amin et al. | |
| 7,469,556 | B2 | 12/2008 | Howard | |
| 7,575,624 | B2 | 8/2009 | Cartwright et al. | |
| 7,591,150 | B2 | 9/2009 | Turner et al. | |
| 7,594,414 | B2 | 9/2009 | Wilding et al. | |
| 7,765,920 | B2 | 8/2010 | Keller | |
| 8,245,727 | B2 | 8/2012 | Mooney et al. | |
| 8,250,883 | B2 | 8/2012 | Migliore et al. | |
| 2003/0196452 | A1 | 10/2003 | Wilding et al. | |
| 2004/0083888 | A1 | 5/2004 | Qualls | |
| 2004/0105812 | A1 | 6/2004 | Tonkovich et al. | |
| 2004/0148962 | A1 | 8/2004 | Rashad et al. | |
| 2004/0177646 | A1 | 9/2004 | Wilkinson et al. | |
| 2005/0056313 | A1* | 3/2005 | Hagen | B01F 5/0453 137/3 |
| 2005/0144979 | A1 | 7/2005 | Zollinger et al. | |
| 2005/0183452 | A1 | 8/2005 | Hahn et al. | |
| 2005/0220704 | A1 | 10/2005 | Morrow et al. | |
| 2005/0279132 | A1 | 12/2005 | Eaton et al. | |
| 2006/0048540 | A1* | 3/2006 | Voss et al. | 62/606 |
| 2006/0053806 | A1 | 3/2006 | Tassel | |
| 2006/0213222 | A1 | 9/2006 | Whitesell | |
| 2006/0218939 | A1 | 10/2006 | Turner et al. | |
| 2007/0017250 | A1 | 1/2007 | Turner et al. | |
| 2007/0107465 | A1 | 5/2007 | Turner et al. | |
| 2007/0137246 | A1 | 6/2007 | McKellar et al. | |
| 2007/0193303 | A1 | 8/2007 | Hawrysz et al. | |
| 2008/0156035 | A1 | 7/2008 | Aspelund et al. | |
| 2008/0264076 | A1 | 10/2008 | Price et al. | |
| 2009/0071634 | A1* | 3/2009 | Turner | B01D 7/02 165/104.26 |
| 2009/0217701 | A1 | 9/2009 | Minta et al. | |
| 2009/0248174 | A1 | 10/2009 | Taha et al. | |
| 2009/0277217 | A1 | 11/2009 | Ransbarger et al. | |
| 2010/0018248 | A1 | 1/2010 | Fieler et al. | |
| 2010/0088920 | A1 | 4/2010 | LaRou | |
| 2010/0186446 | A1 | 7/2010 | Turner et al. | |
| 2010/0223950 | A1 | 9/2010 | Malsam | |
| 2010/0313597 | A1 | 12/2010 | Bridgwood | |
| 2012/0103012 | A1 | 5/2012 | Turner et al. | |
| 2012/0103561 | A1 | 5/2012 | Turner et al. | |
| 2013/0340475 | A1 | 12/2013 | Turner et al. | |

FOREIGN PATENT DOCUMENTS

| | | | |
|---|---|---|---|
| EP | 1 205 721 | A1 | 5/2002 |
| FR | 2805034 | A1 | 8/2001 |
| GB | 1135871 | A | 12/1968 |
| JP | 58-159830 | | 9/1983 |
| JP | 11200817 | A | 7/1999 |
| JP | 2002071861 | A | 3/2002 |
| WO | 88/00936 | | 2/1988 |
| WO | 98/59206 | | 12/1998 |
| WO | 03/062725 | A | 7/2003 |
| WO | 03064947 | A1 | 8/2003 |
| WO | 2005114076 | A1 | 12/2005 |
| WO | 2010023238 | A1 | 3/2010 |

OTHER PUBLICATIONS

Search Report for PCT/US2007/084677 dated Jul. 1, 2008.
International Preliminary Report for PCT/US08/68938 dated Mar. 16, 2010.
Search Report for PCT/US2010/045340 dated Oct. 13, 2010.
Search Report for PCT/US2010/045332 dated Oct. 18, 2010.
Search Report for PCT/US2008/051012 dated May 20, 2008.
Search Report for PCT/US2010/045321 dated Oct. 1, 2010.
International Preliminary Examination Report for PCT/US2002/20924 dated Jun. 17, 2003.
Search Report for PCT/US1998/027232, dated Jul. 7, 1999.
PCT International Search Report and Written Opinion of the International Searching Authority for PCT/US2011/059047, dated Mar. 19, 2012, 10 pages.
A National Vision of America's Transition to a Hydrogen Economy-To 2030 and Beyond, Based on the results of the National Hydrogen Vision Meeting Washington, DC Nov. 15-16, 2001, United States Department of Energy.
Curtin University of Technology, LNG Microcell Progress Update, May 2002, Curtin/Corelab.
Generation of Hydrogen and Transportation and Transmission of Energy Generated on the U.S. Outer Continental Shelf to Onshore, (Minerals Management Service), May 2006.
Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, P.
Hydrogen as an Energy Carrier and its Production by Nuclear Power, IAEA-TECDOC-1085, International Atomic Energy Agency, May 1999.
"Hydrogen Infrastructure Delivery, Reliability R&D Needs," Science Applications International Corporation, Prepared for U.S. Department of Energy, NETL Natural Gas & Infrastructure Reliability Program, 2007, <www.netl.doe.gov/technologies/oil-gas/publications/td/Final%20White%20Paper%20072604.pdf>.
International Search Report for PCT/US02/20924, dated Sep. 17, 2002 (4 pages).
Mott Corporation, "Porous metal solutions," Jun. 2007, 16 pages.
Porous Metal Design Guidebook, Metal Powder Industries Federation, Princeton, NJ, http://www.mpif.org/designcenter/porous.pdf , Jun. 2007, 25 pages.
The Hydrogen Economy: Opportunities, Costs, Barriers, and R&D Needs, National Academy of Engineering and Board on Energy and Environmental Systems, 2004, The National Academies Press, <http://books.nap.edu/books/0309091632/html/index.html>.
The Hydrogen Initiative, Panel on Public Affairs, American Physical Society, Mar. 2004, <http://www.aps.org/public_affairs/popa/reports/index.cfm>.
PCT International Preliminary Report on Patentability and Written Opinion for PCT/US2006/041039 dated Apr. 9, 2009, 7 pages.
PCT International Preliminary Report on Patentability and Written Opinion for PCT/US2007/084677 dated May 28, 2009, 7 pages.
PCT International Search Report and Written Opinion for PCT/US08/68938 dated Oct. 10, 2008, 8 pages.
PCT International Preliminary Report on Patentability and Written Opinion for PCT/US2008/051012 dated Aug. 27, 2009, 7 pages.
U.S. Appl. No. 12/603,948, filed Oct. 22, 2009, titled, "Complete Liquefaction Methods and Apparatus," by Turner et al.
U.S. Appl. No. 12/604,139, filed Oct. 22, 2009, titled, "Natural Gas Liquefaction Core Modules, Plants Including Same and Related Methods," by Wilding et al.
U.S. Appl. No. 12/604,194, filed Oct. 22, 2009, titled, "Methods of Natural Gas Liquefaction and Natural Gas Liquefaction Plants Utilizing Multiple and Varying Gas Streams," by Wilding et al.
PCT International Preliminary Report on Patentability and Written Opinion for PCT/US2010/045321 dated Oct. 1, 2010, 6 pages.
PCT International Preliminary Report on Patentability and Written Opinion for PCT/US2010/045332 dated Oct. 18, 2010, 11 pages.
Bodner Research Web, "Phase Diagrams," http://chemed.chem.purdue.edu/genchem/topicreview/bp/ch14/phase.php.
Relations between height, pressure, density and temperature, http://www.aerostudents.com/files/aerodynamicsA/relationsPressureHeight.pdf.
Office Action for Chinese Patent Application No. 201180051634.4, Issued Jun. 30, 2015, 8 pages.

* cited by examiner

VAPORIZATION CHAMBERS AND ASSOCIATED METHODS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATIONS

The present application is related to co-pending U.S. patent application Ser. No. 11/855,071 filed on Sep. 13, 2007, titled HEAT EXCHANGER AND ASSOCIATED METHODS, now U.S. Pat. No. 8,061,413, issued Nov. 22, 2011, U.S. patent application Ser. No. 12/938,826, filed Nov. 3, 2010, titled "HEAT EXCHANGER AND RELATED METHODS," now U.S. Pat. No. 9,217,603, issued Dec. 22, 2015, and U.S. patent application Ser. No. 12/938,967, filed Nov. 3, 2010, titled "SUBLIMATION SYSTEMS AND ASSOCIATED METHODS," now U.S. Pat. No. 9,254,448, issued Feb. 9, 2016, the disclosure of each of which application is incorporated by reference herein in its entirety.

TECHNICAL FIELD

The invention relates generally to vaporization chambers and methods associated with the use thereof. More specifically, embodiments of the invention relate to vaporization chambers including a conduit with discrete apertures formed therein. Embodiments of the invention additionally relate to the methods of heat transfer between fluids, the vaporization of liquids within a fluid mixture, and the conveyance of fluids.

BACKGROUND

The production of liquefied natural gas is a refrigeration process that reduces the mostly methane ($CH_4$) gas to a liquid state. However, natural gas consists of a variety of gases in addition to methane. One of the gases contained in natural gas is carbon dioxide ($CO_2$). Carbon dioxide is found in quantities around 1% in most of the natural gas infrastructure found in the United States, and in many places around the world the carbon dioxide content is much higher.

Carbon dioxide can cause problems in the process of natural gas liquefaction, as carbon dioxide has a freezing temperature that is higher than the liquefaction temperature of methane. The high freezing temperature of carbon dioxide relative to methane will result in solid carbon dioxide crystal formation as the natural gas cools. This problem makes it necessary to remove the carbon dioxide from the natural gas prior to the liquefaction process in traditional natural gas processing plants. The filtration equipment to separate the carbon dioxide from the natural gas prior to the liquefaction process may be large, may require significant amounts of energy to operate, and may be very expensive.

Small-scale liquefaction systems have been developed and are becoming very popular. In most cases, these small plants are simply using a scaled down version of existing liquefaction and carbon dioxide separation processes. The Idaho National Laboratory has developed an innovative small-scale liquefaction plant that eliminates the need for expensive, equipment intensive, pre-cleanup of the carbon dioxide. The carbon dioxide is processed with the natural gas stream and during the liquefaction step, the carbon dioxide is converted to a crystalline solid. The liquid/solid slurry is then transferred to a separation device that directs a clean liquid out of an overflow, and a carbon dioxide concentrated slurry out of an underflow.

The underflow slurry is then processed through a heat exchanger to sublime the carbon dioxide back into a gas. In theory, this is a very simple step. However, the interaction between the solid carbon dioxide and liquid natural gas produces conditions that are very difficult to address with standard heat exchangers. In the liquid slurry, carbon dioxide is in a pure or almost pure sub-cooled state and is not soluble in the liquid. The carbon dioxide is heavy enough to quickly settle to the bottom of most flow regimes. As the settling occurs, piping and ports of the heat exchanger can become plugged as the quantity of carbon dioxide builds. In addition to collecting in undesirable locations, the carbon dioxide has a tendency to clump together making it even more difficult to flush through the system.

The ability to sublime the carbon dioxide back into a gas is contingent on getting the solids past the liquid phase of the gas without the solids collecting and clumping into a plug. As the liquid natural gas is heated, it will remain at approximately a constant temperature of about −230° F. (at 50 psig) until all the liquid has passed from a two-phase gas to a single-phase gas. The solid carbon dioxide will not begin to sublime back into a gas until the surrounding gas temperatures have reached approximately −80° F. While the solid carbon dioxide is easily transported in the liquid methane, the ability to transport the solid carbon dioxide crystals to warmer parts of the heat exchanger is substantially diminished as liquid natural gas vaporizes. At a temperature when the moving, vaporized natural gas is the only way to transport the solid carbon dioxide crystals, the crystals may begin to clump together due to the tumbling interaction with each other, leading to the aforementioned plugging.

In addition to clumping, as the crystals reach warmer areas of the heat exchanger they begin to melt or sublime. If melting occurs, the surfaces of the crystals become sticky, causing the crystals to have a tendency to stick to the walls of the heat exchanger, thereby reducing effectiveness of the heat exchanger and creating localized fouling. The localized fouling areas may cause the heat exchanger to become occluded and eventually plug if fluid velocities cannot dislodge the fouling.

In view of the shortcomings in the art, it would be advantageous to provide a vaporization chamber and associated methods that would enable the effective and efficient vaporization of liquid therein and the efficient transfer of solid carbon dioxide to a sublimation device.

BRIEF SUMMARY

In accordance with one embodiment of the invention a vaporization chamber may include at least one conduit and a shell. The at least one conduit may have an inlet at a first end, an outlet at a second end and a flow path therebetween. The shell may surround a portion of the at least one conduit and define a chamber surrounding the portion of the at least one conduit. Additionally, a plurality of discrete apertures may be positioned at longitudinal intervals in a wall of the conduit, each discrete aperture of the plurality of discrete apertures sized and configured to direct a jet of fluid into the at least one conduit from the chamber.

In accordance with another embodiment of the invention, a method is provided for vaporizing a liquid by directing a first fluid comprising a liquid into an inlet at a first end of the conduit, directing jets of a second fluid into the conduit from a chamber surrounding a portion of the conduit through discrete apertures in a wall of the conduit and transferring heat from the second fluid to the first fluid. Additionally, a mixture comprising the first fluid and the second fluid may be directed through an outlet at a second end of the conduit.

DETAILED DESCRIPTION

Figure 1A:
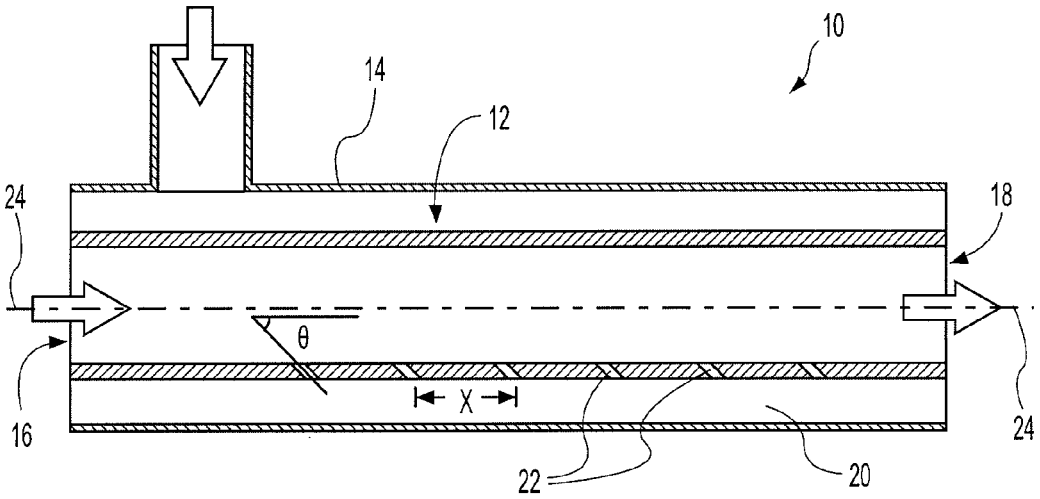
FIG. 1A depicts a longitudinal cross-sectional detail view of a vaporization chamber according to an embodiment of the present invention.

FIG. 1A shows a cross-sectional detail view of a vaporization chamber 10 according to an embodiment of the present invention. It is noted that, while operation of embodiments of the present invention is described in terms of the vaporization of liquid natural gas carrying a solid carbon dioxide in the processing of natural gas, the present invention may be utilized for the vaporization, sublimation, heating, cooling, and mixing of other fluids and for other processes, as will be appreciated and understood by those of ordinary skill in the art.

The term "fluid" as used herein means any substance that may be caused to flow through a conduit and includes, but is not limited to, gases, two-phase gases, liquids, gels, plasmas, slurries, solid particles, and any combinations thereof.

Figure 1B:
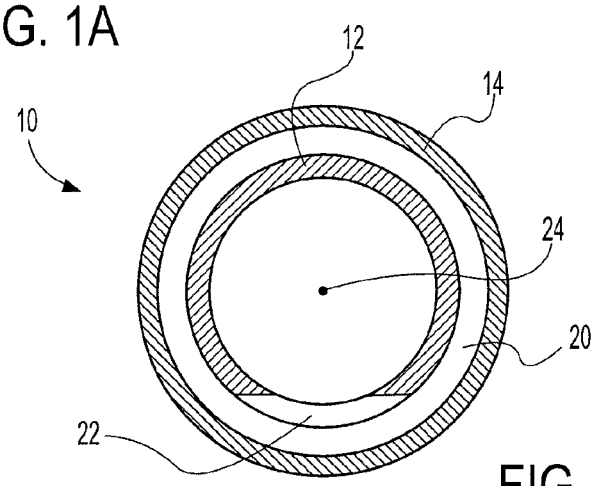
FIG. 1B depicts a transverse cross-sectional detail view of the vaporization chamber of FIG. 1A.

As shown in FIG. 1, the vaporization chamber 10 may include at least one conduit 12 extending through a shell 14. The conduit 12 may have an inlet 16 at a first end, an outlet 18 at a second end and a flow path therebetween. The shell 14 may surround at least a portion of the conduit 12 and define a chamber 20 around the portion of conduit 12. In some embodiments, the conduit 12 may be coaxial with the shell 14, as shown in FIG. 1B. However, in additional embodiments, a conduit may be directed through any portion of a shell. Additionally, the conduit 12 may include a plurality of discrete apertures 22 positioned at longitudinal intervals in a wall of the conduit 12, each discrete aperture 22 of the plurality of discrete apertures 22 may be sized and configured to direct a relatively high velocity jet of fluid (e.g., heated gas) into the flow path of the conduit 12 from the chamber 20.

Figure 2:
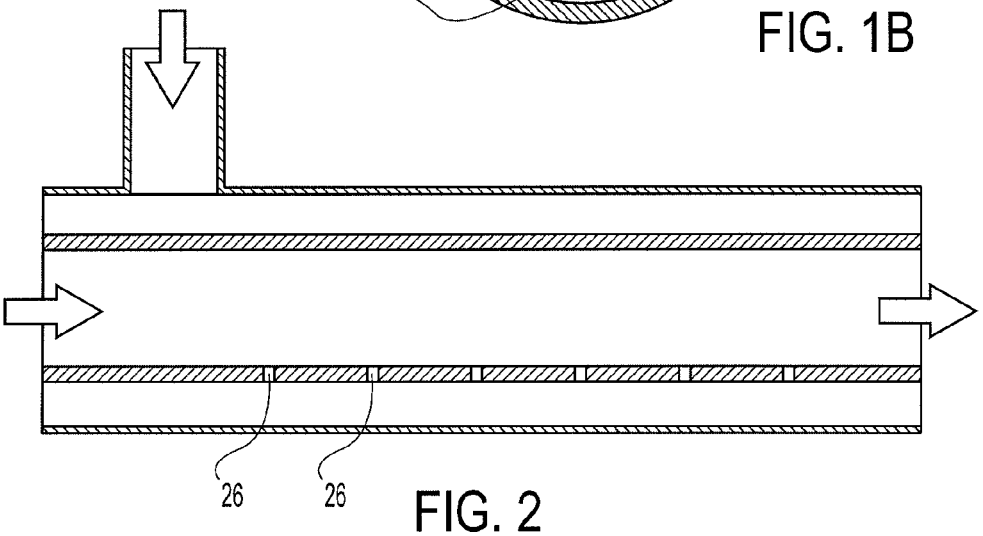
FIG. 2 depicts a longitudinal cross-sectional detail view of a vaporization chamber including apertures having a perpendicular orientation according to an embodiment of the present invention.

Each discrete aperture 22 may be positioned at an angle θ with respect to a longitudinal axis 24 of the conduit 12. For example, as shown in FIG. 1, each discrete aperture 22 may be positioned at an acute angle θ (i.e., an angle less than ninety degrees (90°)) with respect to the longitudinal axis 24 of the conduit 12. As a non-limiting example, each discrete aperture 22 may be positioned at an angle θ of about forty-five degrees (45°) with respect to the longitudinal axis 24 of the conduit 12. This may allow a jet of fluid to be directed into the conduit 12 from the chamber 20 through a discrete aperture 22 at a direction that opposes the average flow direction of fluid through the conduit 12. In additional embodiments, apertures 26 may be positioned perpendicular to a longitudinal axis of a conduit, as shown in FIG. 2, or may be positioned at another angle relative to the longitudinal axis of the conduit. Referring again to FIG. 1A, in some embodiments, each of the discrete apertures 22 may be positioned at the same angle θ relative to the longitudinal axis 24 of the conduit 12. In additional embodiments, the discrete apertures 22 may be positioned at various angles relative to the longitudinal axis 24 of the conduit 12, and at different angles with respect to other discrete apertures 22 of the conduit 12. For example, the relative angle θ of the discrete apertures 22 may vary with respect to their longitudinal or circumferential position relative to the conduit 12 (not shown).

The plurality of discrete apertures 22 may be spaced at longitudinal intervals along the length of the conduit 12, such as shown in FIG. 1A. Each discrete aperture 22 may be spaced longitudinally a distance X from another discrete aperture 22 in the conduit 12. This spacing may allow for a recirculation effect between the longitudinally spaced discrete apertures 22 of the conduit 12. For example, the spacing may be selected by utilizing computational fluid-dynamics (CFD) simulations to increase the maximum residence time of fluid within the vaporization chamber 10, which may result in a more complete vaporization of a liquid component of the fluid. In some embodiments, the spacing distance X between the discrete apertures 22 may be constant, and the discrete apertures 22 may be evenly distributed along the length of the conduit 12. In additional embodiments, the spacing distance X may vary along the length of the conduit 12. For example, the spacing distance X between the discrete apertures 22 may increase along the length of the conduit 12.

Figure 3A:
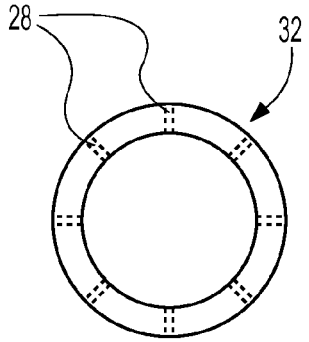
FIG. 3A depicts a transverse cross-sectional view of a conduit for a vaporization chamber according to an embodiment of the present invention, the conduit having apertures in an annular arrangement.
Figure 3B:
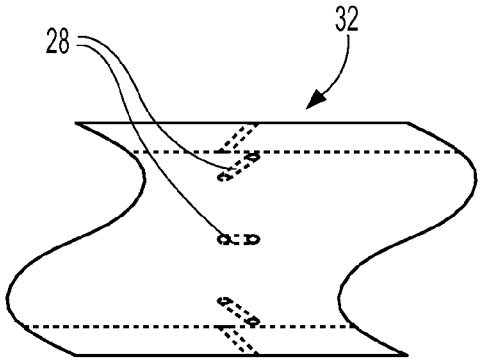
FIG. 3B depicts a longitudinal cross-sectional detail view of a portion of the conduit of FIG. 3A.
Figure 4A:
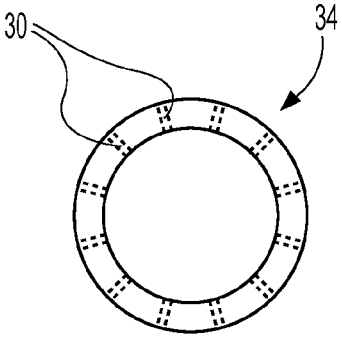
FIG. 4A depicts a transverse cross-sectional view of a conduit for a vaporization chamber according to an embodiment of the present invention, the conduit having apertures in a helical arrangement.
Figure 4B:
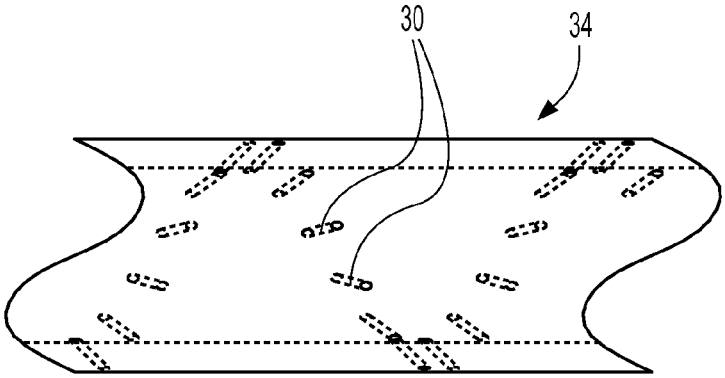
FIG. 4B depicts a longitudinal cross-sectional detail view of a portion of the conduit of FIG. 4A.

In some embodiments, such as shown in FIGS. lA and 1B, the discrete apertures 22 may be positioned solely or primarily along the bottom of the conduit 12, which may assist in distributing denser components of the fluid throughout the conduit 12, as denser components may tend to move toward the bottom of the conduit 12 due to gravity. In additional embodiments, apertures 28, 30 may be spaced circumferentially in the wall of the conduit 32, 34, respectively, as shown in FIGS. 3A, 3B, 4A and 4B. For example, as shown in FIG. 3B, the apertures 28 may be spaced circumferentially along the wall of the conduit 32 at longitudinal intervals in annular arrangements. In another example, as shown in FIG. 4B, each aperture 30 may be spaced circumferentially and longitudinally from an adjacent aperture 30 and be positioned along the wall of the conduit 34 in a spiral arrangement (i.e., a helical arrangement).

Referring to FIGS. 1A and 1B, the size of discrete apertures 22 may be relatively small in comparison to the size of the conduit 12. For example, the cross-sectional area of an opening of a discrete aperture 22 may be less than about 1/100 the size of the cross-sectional area of the conduit 12. Additionally, the shape of the discrete apertures 22 may be selected according to the jet configuration desired. In some embodiments, such as shown in FIGS. lA and 1B, the discrete apertures 22 may be configured as slots cut into the wall of the conduit 12 to provide fan-shaped jets. In additional embodiments, such as shown in FIGS. 3A, 3B, 4A and 4B, the apertures 28, 30 may be configured as cylindrical openings formed in the wall of the conduit 32, 34 to provide one of generally cylindrical-shaped jets and generally frustoconical-shaped jets, depending on fluid pressure differences, relative fluid densities and other fluid conditions. In further embodiments, apertures having other shapes and combinations of apertures having various shapes may be provided in the wall of a conduit, the shape of each aperture selected to provide a specific jet pattern. The discrete apertures 22, 26, 28, 30 may be formed in the wall of the conduit 12, 32, 34, respectively, by any number of machining techniques, including, but not limited to, wire electrical discharge machining (EDM), sinker EDM, electrochemical machining (ECM), laser-beam machining, electron-beam machining (EBM), water-jet machining, abrasive-jet machining, plasma cutting, milling, sawing, punching and drilling.

Figure 5A:
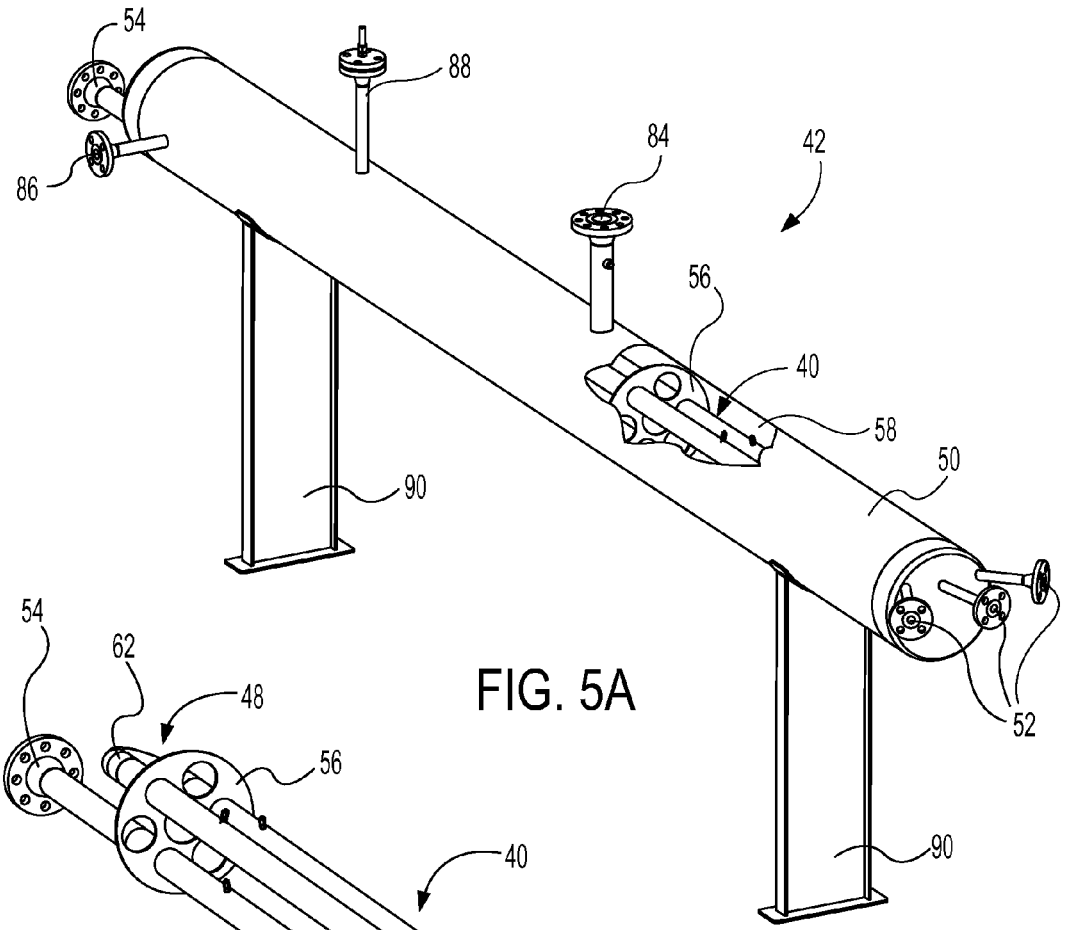
FIG. 5A depicts an isometric partial cutaway view of a vaporization chamber having a conduit with elbows according to an embodiment of the present invention.
Figure 5B:
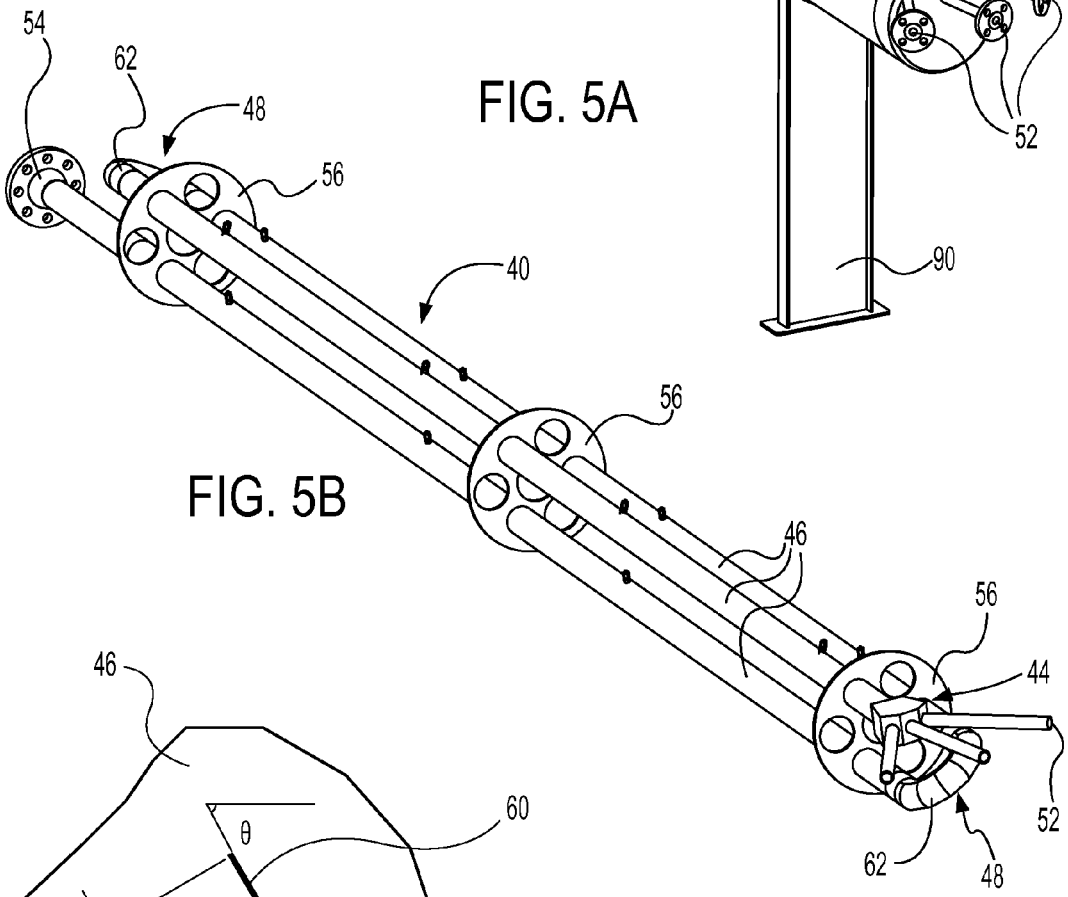
FIG. 5B depicts an isometric view of the conduit of the vaporization chamber of FIG. 5A.
Figure 5C:
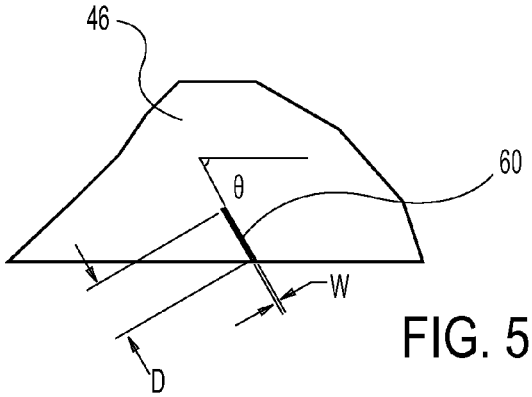
FIG. 5C depicts a detail view of a discrete aperture of the conduit of FIG. 5B.

As shown in FIGS. 5A-5C, a conduit 40 of a vaporization chamber 42 may be configured with an inlet manifold 44 to receive fluid from a plurality of fluid sources into the conduit 40. The conduit 40 may additionally include a plurality of lengths of pipe 46 connected with elbows 48 to allow for a reduced overall length of a surrounding shell 50. Each length of pipe 46 of the conduit 40 may be positioned below a previous length of pipe 46 of the conduit 40, respectively, from an inlet 52 to an outlet 54. The conduit 40 may be supported within the shell 50 by a support structure, such as a plurality of support plates 56, that may maintain the position of the conduit 40 relative to the shell 50 and that may allow the flow of fluid in a chamber 58 therepast. Each length of pipe 46 may have a solid wall, with the exception of discrete apertures 60 (FIG. 5C) formed along the length thereof, and each elbow 48 may include a porous wall 62.

Figure 6:
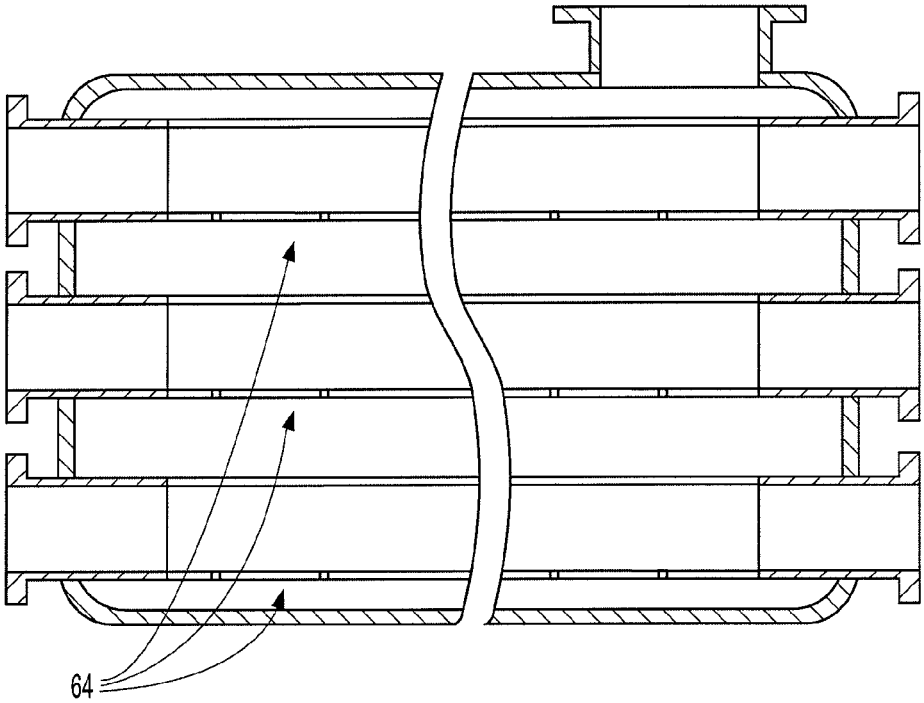
FIG. 6 depicts a longitudinal cross-sectional view of a vaporization chamber that includes multiple conduits according to an embodiment of the present invention.

Forming the conduit 40 with one or more elbows 48, as shown in FIG. 5B, and/or employing a plurality of conduits 64, as shown in FIG. 6, may allow flexibility in the manufacture of a vaporization chamber. This flexibility in manufacture may facilitate flexibility in the size and shape of a vaporization chamber, as well as flexibility in the locations of inlets and outlets. This also may facilitate the manufacture of a vaporization chamber to fit within a limited floor space and may allow for an efficient flow design for a processing plant incorporating such a vaporization chamber.

Figure 7:
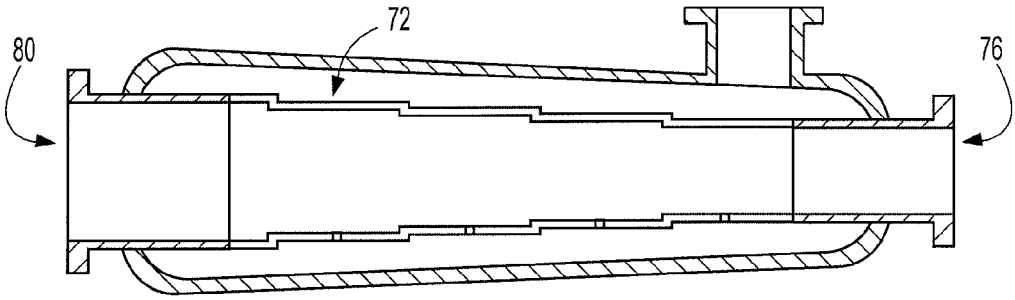
FIG. 7 depicts a longitudinal cross-sectional view of a vaporization chamber that includes a conduit having a stepped taper according to an embodiment of the present invention.
Figure 8:
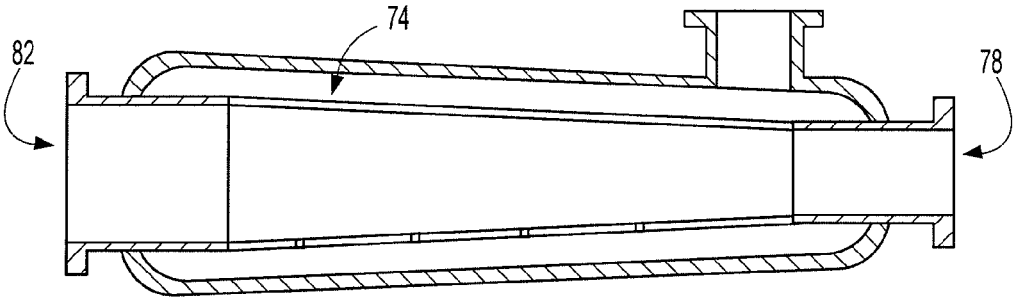
FIG. 8 depicts a longitudinal cross-sectional view of a vaporization chamber that includes a conduit having a substantially continuous taper according to an embodiment of the present invention.

In additional embodiments, vaporization chambers may be configured with a conduit that has a varying cross-sectional area, as shown in FIGS. 7 and 8. For example, as shown in FIG. 7, a conduit 72 may comprise a pipe that is step-tapered, having an internal cross-sectional area near an inlet end 76 smaller than an internal cross-sectional area near an outlet end 80. For another example, as shown in FIG. 8, a conduit 74 may comprise a pipe that is continuously tapered, having an internal cross-sectional area near an inlet end 78 that is smaller than an internal cross-sectional area near an outlet end 82.

The cross-sectional area of a conduit may affect flow conditions within the conduit. For example, as shown in FIG. 1A, as fluid enters the conduit 12 from the chamber 20 through the discrete apertures 22, the mass flow rate through the conduit 12 will increase along the length of the conduit 12. If the cross-sectional area of the conduit 12 remains constant as the mass flow rate increases, the velocity of the flow will increase (assuming that there is little additional compression of the fluid). As shown in FIGS. 7 and 8, if it is desired to control the flow velocity within the conduit 72, 74 the cross-sectional area of the conduit 72, 74 may be varied along its length to affect the flow velocity. For example, the cross-sectional area of the conduit 72, 74 may be increased along its length such that the velocity of the flow may be relatively constant throughout the conduit 72, 74. Likewise, if higher flow velocities are desired as the fluid flows through a conduit, the cross-sectional area of the conduit may be decreased along its length.

Referring again to FIG. 5B, the configuration and orientation of the lengths of pipe 46 of the conduit 40 may affect the flow of the fluid therethrough, especially if the fluid contains solid particles, such as solid carbon dioxide. The particles may be drawn downward by gravity, and so it may be desirable to orient each length of pipe 46 of the plurality such that the fluid flow through the lengths of pipe 46 is mostly horizontal. A horizontally oriented flow may cause solid particles to be conveyed within the lengths of pipe 46 at a velocity similar to the gases and/or liquids within which the solid particles are suspended.

Referring to FIG. 5A, the surrounding shell 50 may have a shape selected for pressurization, such as a generally cylindrical shape, and may include a plurality of openings therethrough for the passage of inlets 52, 84, outlets 54, 86, and instrumentation ports 88. Each opening in the shell 50 may be sealed to a conduit extending therethrough, such as by a weld, to allow the chamber 58 to be pressurized. Additionally, a support structure, such as legs 90, may be attached to the shell 50.

As shown in FIG. 5A, inlets 52 to the conduit 40 may pass through a first end of the shell 50, and an outlet 54 from the conduit 40 may pass through a second end of the shell 50. A fluid inlet 84 to the chamber 58 may be positioned near a center of the shell 50 and a fluid outlet 86 from the chamber 58 may be positioned near the second end of the shell 50, proximate to the outlet 54 from the conduit 40. Additionally, an instrumentation port 88 may extend through the shell 50 to provide communication access for instrumentation within the; shell 50, such as temperature sensors, pressure sensors, etc.

When used in conjunction with a natural gas liquefaction plant, such as described in U.S. Pat. No. 6,962,061 to Wilding et al., the disclosure of which is incorporated herein in its entirety by reference, the inlets 52 to the conduit 40 may be coupled to an underflow outlet of one or more hydrocyclones. The outlet 54 of the conduit 40 may be coupled to an inlet of a sublimation device, such as described in U.S. patent application Ser. No. 12/938,826, filed Nov. 3, 2010, now U.S. Pat. No. 9,217,603, issued Dec. 22, 2015, titled "HEAT EXCHANGER AND RELATED METHODS," and U.S. patent application Ser. No. 12/938,967, filed Nov. 3, 2010, now U.S. Pat. No. 9,254,448, issued Feb. 9, 2016, titled "SUBLIMATION SYSTEMS AND ASSOCIATED METHODS,"the disclosures of each of which are previously incorporated herein. The inlet 84 of the chamber 58 may be coupled to a gaseous natural gas stream and the gas from the outlet 86 may be redirected into the natural gas liquefaction plant, may be directed into a natural gas pipeline, may be combusted, such as by a torch or a power plant, or otherwise directed from the chamber 58. In additional embodiments, no outlet may be included, or the outlet 86 may be capped, such as by a blind flange, and all of the gas directed into the vaporization chamber 42 may be directed out of the outlet 54 of the conduit 40.

In operation, a first fluid, such as a slurry comprising liquid natural gas and crystals of solid carbon dioxide precipitate, may be directed into an inlet 52 of the conduit 40. As the first fluid flows through the conduit 40, the heavier portions of the first fluid may tend to move to the bottom of the flow regime due to gravity. In view of this, the first fluid flow may naturally tend to stratify, with the denser portions (i.e., the liquid and solid portions) settling to the bottom and the less dense portions (i.e., gaseous portions) flowing over the denser portions of the first fluid.

As the first fluid is directed into the inlets 52 of the conduit 40, a second fluid, such as relatively warm natural gas, may be directed into the inlet 84 of the chamber 58 within the shell 50. As the first fluid flows through the conduit 40, the second fluid is directed into the conduit 40 through the discrete apertures 60 (FIG. 5C) from the surrounding chamber 58. In view of this, the relatively warm second fluid may transfer heat through the solid wall of the conduit 40 to the first fluid, and the second fluid may transfer heat to the first fluid through direct mixing within the conduit 40. The flow of the second fluid through the discrete apertures 60 may be induced by a pressure gradient between the chamber 58 and the interior of the conduit 40. For example, the pressure inside of the conduit 40 may be about 1 psi to about 50 psi less than the pressure of the chamber 58. In one example, the pressure inside the conduit 40 may be about 5 psi less than the pressure of the chamber 58. As the second fluid is directed into the conduit 40 in individual jets through the discrete apertures 60, the liquid portions of the first fluid may be broken up, such as into droplets and mixed with the gaseous portions of the fluid within the conduit 40. Additionally, the jets of the second fluid may create turbulence in the fluid flow through the conduit 40, which may cause mixing and inhibit flow stratification. The breaking up of the liquid portions of the first fluid, such as into droplets, may increase the surface area of the liquid and promote vaporization. Additionally, the turbulence and mixing generated by the jets through the discrete apertures 60 may also promote heat transfer from the second fluid to the first fluid and promote vaporization.

As the first fluid is directed through the conduit 40, the discrete apertures 60 directing jets of second fluid into the conduit 40 may be positioned at longitudinal distances that are optimized to create recirculation zones in the flow through the conduit 40. Additionally, the angle θ of the discrete apertures 60 may be selected to create jets that are directed upstream, relative to the average flow direction through each length of pipe 46 of the conduit 40, which may increase turbulence and break up the liquid portions of the first fluid.

Any elbows 48 used to change the direction of the flow as it travels through the conduit 40 may comprise a porous wall 62. The porous wall 62 may allow the second fluid to flow through the porous wall 62 and create a boundary layer of warm fluid near the inner wall of the elbow 48, which may prevent solids in the fluid flow from sticking the walls of the elbows 48 as the fluid flow changes direction.

If, for example, carbon dioxide crystals were to adhere to a portion of the porous wall 62, the continuous flow of the heated first fluid through the porous wall 62 may heat the carbon dioxide crystals that adhere to the porous wall 62. The heating of the carbon dioxide crystals will result in the melting or sublimation of the crystals, which may cause the crystals to release from the porous wall 62 or cause the carbon dioxide to fully transition to a gaseous form. This may reduce the amount of localized fouling that may occur within the conduit 40 at a given time, and may allow the first fluid to continuously flow through the conduit 40 during the operation of the vaporization chamber 42. Additionally, portions of the interior wall, or the entire interior wall, of the conduit 40 may be polished to inhibit the adhesion of solids thereto.

The temperature of the second fluid may be selected to be above the vaporization temperature of the liquid portion of the first fluid (i.e., above the vaporization temperature of methane) and, upon mixing with the first fluid, to be below the sublimation temperature of a solid portion of the first fluid (i.e., below the sublimation temperature of carbon dioxide). In view of this, the liquid portion of the first fluid may be substantially vaporized and the mixture of the first fluid and second fluid that is directed out of the conduit 40 may be substantially free of a liquid phase and may consist essentially of a solid phase (i.e., solid carbon dioxide) suspended in a gaseous phase (i.e., gaseous natural gas).

Example Embodiment

In one embodiment, as shown in FIGS. 5A-5C, a conduit 40 includes three lengths of two-inch nominal size, Schedule 10 (2.375 inches outer diameter; 2.157 inches inner diameter; 60.33 mm outer diameter; 54.79 mm inner diameter), stainless steel pipe 46, according to the American National Standards Institute (ANSI) and the American Society of Mechanical Engineers (ASME) standard ANSI/ASME 36.19M. Each length of pipe 46 is about 160 inches (about 406 cm) and includes eight discrete apertures 60 formed as slots therein. Each discrete aperture 60 is spaced about 28 inches (about 71 cm) from another discrete aperture 60 and positioned at the bottom of a length of the stainless steel pipe 46. As shown in FIG. 5C, each slot, having a width W of about 0.015 inch (about 0.38 mm), has a depth D of about 0.313 inch (about 7.95 mm) at an angle of about sixty degrees (60°), formed by a wire EDM process. The angle of about 60° was selected for ease of manufacturing; however, computer modeling suggests that an angle of about forty-five degrees (45°) may also be a particularly effective angle for this configuration. The number and size of the discrete apertures 60 is based on a predetermined acceptable pressure drop and the predetermined mass of the heated second fluid to be added.

To reduce the overall length of the shell 50, the three pipes 46 are placed in a parallel configuration, a second pipe 46 positioned below a first pipe 46 and a third pipe 46 positioned below the second pipe 46, and connected by two 180 degree-elbows 48. This configuration allows gravity to assist the flow through each of the elbows 48. Each elbow 48 includes a porous wall 62, particularly at the outer radius thereof.

In operation, a first fluid may enter the conduit 40 through an inlet 52 as a slurry comprising liquid methane and solid carbon dioxide at a temperature of about −218.6° F (about −139.2° C.), a pressure of about 145 psia (about 1,000kPa)

and a mass flow rate of about 600 lbm/hr (about 272 kg/hr). A second fluid may enter the chamber 58 through the inlet 84 as gaseous methane at a temperature of about 250° F. (about 121.1° C.), a pressure of about 150 psia (about 1,034kPa) and a mass flow rate of about 800 lbm/hr (about 362.9 kg/hr). The mixture of the first fluid and the second fluid is then directed through the outlet 54 from the conduit 40 as a solid carbon dioxide suspended in gaseous methane at a temperature of about −96.42° F. (about −71.34° C.) and a pressure of about 145 psia (about 1,000kPa).

As the first fluid is conveyed through the conduit 40, the heat energy provided by the second fluid may be used to facilitate a phase change of the liquid methane of the first fluid to gaseous methane. As this transition occurs, the temperature of the first fluid may remain at about −230° F. (this temperature may vary depending upon the pressure of the fluid) until all of the liquid methane of the first fluid is converted to gaseous methane. The solid carbon dioxide of the first fluid may then be suspended in the combined gaseous methane of the first and second fluids, but will not begin to sublime until the temperature of the combined fluids has reached about −80° F. (this temperature may vary depending upon the pressure of the fluid environment). As the temperature required to sublime the carbon dioxide is higher than the vaporization temperature of the methane, the solid carbon dioxide will be suspended in gaseous methane while a mixture of the first fluid and the second fluid exits the conduit 40.

In light of the above disclosure it will be appreciated that the apparatus and methods depicted and described herein enable the effective and efficient vaporization of a liquid within a fluid flow. The invention may further be useful for a variety of applications other than the specific examples provided. For example, the described apparatus and methods may be useful for the effective and efficient mixing, heating, cooling, and/or conveyance of fluids.

While the invention may be susceptible to various modifications and alternative forms, specific embodiments of which have been shown by way of example in the drawings and have been described in detail herein, it should be understood that the invention is not intended to be limited to the particular forms disclosed. Rather, the invention includes all modifications, equivalents, and alternatives falling within the scope of the invention as defined by the following appended claims and their legal equivalents. Additionally, features from different embodiments may be combined.

What is claimed is:

1. A vaporization chamber, comprising:

at least one conduit having an inlet at a first end, an outlet at a second end, and a flow path therebetween;

a source of a slurry comprising solid carbon dioxide coupled to the inlet of the at least one conduit;

a shell surrounding a portion of the at least one conduit and defining a chamber surrounding at least a portion of the at least one conduit; and a plurality of discrete apertures positioned at longitudinal intervals in and extending through a solid wall of the at least one conduit, the plurality of discrete apertures positioned solely along a side of the at least one conduit toward which the solid carbon dioxide tends to move when the slurry is flowed through the at least one conduit, at least some discrete apertures of the plurality of discrete apertures sized and oriented at an acute angle with respect to a longitudinal axis of the at least one conduit and in a direction upstream relative to an average direction of flow through the flow path to direct a jet of fluid into the at least one conduit from the chamber to combine the fluid with the slurry comprising solid carbon dioxide.

2. The vaporization chamber of claim 1, wherein each discrete aperture of the plurality of discrete apertures is shaped as one of a cylinder and a slot.

3. The vaporization chamber of claim 1, wherein the at least one conduit comprises a metal pipe.

4. The vaporization chamber of claim 3, wherein the metal pipe comprises a stainless steel pipe.

5. The vaporization chamber of claim 4, wherein at least a portion of an interior of the stainless steel pipe is polished.

6. The vaporization chamber of claim 1, wherein the at least one conduit further comprises at least one elbow.

7. The vaporization chamber of claim 6, wherein the at least one elbow comprises a porous wall.

8. The vaporization chamber of claim 1, wherein the source of the slurry comprising solid carbon dioxide comprises an underflow outlet of a hydrocyclone.

9. The vaporization chamber of claim 8, wherein the outlet of the at least one conduit is coupled to a sublimation chamber.

10. A method of vaporizing a liquid, the method comprising:

directing a first fluid comprising a liquid and solid carbon dioxide into an inlet at a first end of a solid-walled conduit;

directing jets of a second fluid into the conduit from a chamber surrounding the conduit through discrete apertures solely in a bottom wall of the conduit at a direction that opposes an average flow direction of the first fluid through the conduit;

vaporizing the liquid of the first fluid by transferring heat from the second fluid to the first fluid; and directing a mixture comprising the first fluid and the second fluid through an outlet at a second end of the conduit.

11. The method of claim 10, wherein directing the first fluid comprising the liquid and solid carbon dioxide into the inlet further comprises directing a first fluid comprising liquid methane and solid carbon dioxide into the inlet.

12. The method of claim 11, wherein directing jets of the second fluid into the conduit comprises directing jets of gaseous methane into the conduit.

13. The method of claim 12, wherein directing the mixture comprising the first fluid and the second fluid through the outlet at the second end of the conduit comprises directing gaseous methane and solid carbon dioxide through the outlet at the second end of the conduit.

14. The method of claim 10, further comprising directing the first fluid through at least one bend in the conduit.

15. The method of claim 10, wherein directing jets of the second fluid into the conduit comprises directing fan-shaped jets of the second fluid into the conduit.

16. The method of claim 10, further comprising creating turbulence in flow of the liquid of the first fluid through the conduit with the jets of the second fluid.

17. The vaporization chamber of claim 1, wherein the acute angle of orientation of at least some of the at least some discrete apertures is about 45°.

18. The vaporization chamber of claim 1, wherein distances of the longitudinal intervals at which at least some discrete apertures of the plurality of discrete apertures are positioned vary along a length of the at least one conduit.

19. The vaporization chamber of claim 18, wherein the distances of the longitudinal intervals at which at least some discrete apertures of the plurality of discrete apertures are positioned increase along the length of the at least one conduit from the inlet to the outlet.

20. The vaporization chamber of claim 1, wherein the acute angle at which at least some discrete apertures of the plurality of discrete apertures are oriented varies with respect to the position of the at least some discrete apertures relative to the at least one conduit.

21. The vaporization chamber of claim 1, further comprising an inlet manifold configured to direct fluid from a plurality of fluid sources into the at least one conduit.

22. The vaporization chamber of claim 1, wherein the at least one conduit, the shell, and the plurality of discrete apertures are configured to provide a pressure gradient between the chamber and an interior of the at least one conduit, wherein a pressure within the interior of the at least one conduit is less than a pressure within the surrounding chamber during operation of the vaporization chamber.

23. The vaporization chamber of claim 1, wherein the at least one conduit comprises a plurality of lengths of pipe connected with elbows, a first length of pipe of the plurality of lengths of pipe proximate the inlet positioned at a first vertical position, and lengths of pipe of the plurality of lengths of pipe downstream from the first length of pipe positioned at consecutively lower vertical positions than the first vertical position.

24. The vaporization chamber of claim 1, wherein at least some discrete apertures of the plurality of discrete apertures comprise a slot that is angled at the acute angle with respect to the longitudinal axis of the at least one conduit and in the direction upstream relative to the average direction of flow through the flow path.

25. The method of claim 15, wherein directing fan-shaped jets of the second fluid into the conduit comprises directing fan-shaped jets through slot-shaped discrete apertures that are angled in the direction that opposes the average flow direction of the first fluid through the conduit.

26. The vaporization chamber of claim 1, wherein the plurality of discrete apertures is positioned solely along a bottom of the at least one conduit.

27. The vaporization chamber of claim 1, wherein the at least one conduit is oriented horizontally.

* * * * *